United States Patent [19]

Saito et al.

[11] Patent Number: 4,947,623

[45] Date of Patent: Aug. 14, 1990

[54] WRAPPING METHOD

[75] Inventors: Hiroshi Saito; Nobuhiro Saito, both of Saitama, Japan

[73] Assignee: Gorika Giken Co., Ltd., Saitama, Japan

[21] Appl. No.: 303,218

[22] Filed: Jan. 30, 1989

[51] Int. Cl.[5] ..... B65B 57/10

[52] U.S. Cl. ..... 53/493; 53/77; 53/450; 53/550

[58] Field of Search ..... 53/55, 54, 52, 493, 53/77, 450, 550

[56] References Cited

U.S. PATENT DOCUMENTS

| | | | |
|---|---|---|---|
| 4,574,566 | 3/1986 | Eaves et al. | 53/450 |
| 4,712,357 | 12/1987 | Crawford et al. | 53/450 |
| 4,722,168 | 2/1988 | Heaney | 53/450 |
| 4,726,168 | 2/1988 | Seko | 53/450 |

*Primary Examiner*—James F. Coan

*Attorney, Agent, or Firm*—Foley & Lardner, Schwartz, Jeffery, Schwaab, Mack, Blumenthal & Evans

[57] ABSTRACT

A wrapping method for operating a vertical, inclined or horizontal type wrapping machine for wrapping food products such as loaves of bread, wads of noodles or the like with synthetic resin film is free from the problem which are inherent in conventional wrapping machines related to abrupt stopping actions of the wrapping operation whenever products are incorrectly positioned. The method provides a way to bypass the problem by detecting in advance incorrectly positioned products and temporarily halting only the operation of the cutting blades without stopping the overall operation of the machine. The method according to the present invention can significantly enhance the efficiency of the wrapping operation and reduce the time and labor required to remove the trouble in a conventional machine.

1 Claim, 2 Drawing Sheets

WRAPPING METHOD

BACKGROUND OF THE INVENTION

1. Field of the Invention

The present invention relates to a wrapping method using a vertical, inclined or horizontal type wrapping machine for wrapping foods such as loaves of bread, wads of noodles or the like with synthetic resin film.

2. Prior Art

Wrapping machines of various types have been known, and particularly, horizontal type wrapping machines have been widely used in various industries with a view to avoid contamination of products and maintain their commercial values.

FIG. 4 illustrates the configuration of a conventional wrapping machine.

As shown in FIG. 4, a conventional wrapping machine is typically driven by a motor a and has a conveyer S provided with a number of partitions b, b . . . that divide the surface of the conveyor into so many compartments, adjacent to which is located a film feed section CS comprising a feed roller e for feeding film a from d roll of film C, a bag shaper f of a known type for rounding the film d to give it a cylindrical shape, a center sealer g for sealing the lateral edges of the cylindrically rounded film d by heat-sealing to form a tube of film d' and a delivery path i for moving said tube of film d' in the direction of arrow h, said wrapping machine further comprising a top sealing section TS in which a rotary melt-cutter 1 having a pair of heated melt-cutting blades j, k, is provided.

With a conventional wrapping machine as described above, the motor a imparts a desired constant running speed to the conveyer S, which carries food products such as wads of noodles or bags of soup B, B . . . one by one in its compartments formed by partitions b, b, . . . and delivers them to the film feed section CS.

The film feed section CS comprises a roll of film C and a center sealer g, which further comprises a guide roller g1 and a melt-bonding roller g2 to melt-bond both lateral edges of the film to form a tube of film d' so that the delivered products go into the tube of film d' one by one with a constant interval. Then in the top-seal section TS, the tube of film d' containing said products B, B . . . is melt-cut by the rotary melt-cutter 1 which rotates in synchronism with the movement of the tube of film d' and melt-cuts the film at the lines marked on the film d but not shown in the drawing so that the products B, B . . . are separated from one another as the forward end and the rearward end of the wrapping film of each product are melt-bonded and cut to form an individual packet m.

In a conventional wrapping machine as described above, said conveyer S, film feed section CS and top seal section TS are operated synchronously by supplying said film feed section CS and top seal section Ts with mechanical power from the conveyer S, which is driven by the motor a, by way of chain driving mechanisms represented by broken lines M1 and M2 in the drawing so that products B, B . . . are wrapped at a rate of, for example, about 100 products per minute.

A conventional wrapping machine as described above is particularly prone to trouble at the top seal section TS, because if any one of the products B, B . . . is located incorrectly within the tube of film for some reason or another, the rotary melt-cutter 1 can cut into not only the tube of film d' but the product B contained in it. If such an accident happens, the operation of the machine is automatically stopped by a detector mechanism and the supply of electricity to the motor a is interrupted. This interruption of power supply inevitably stops the operation not only of the top seal section TS but also of the film feed section CS and all the other moving sections.

Consequently, the operator who is supplying pieces B, B, . . . to feeding conveyor S has to temporarily stop his operation for corrective measures. If such interruptions occur frequently, it can not only significantly deteriorate his or her performance but also increase his or her physical fatigue and a considerable amount of time and labor will be consumed to remove the faulty product and resume the wrapping operation.

There has been proposed and actually used a number of preventive measures for this kind of troubles by which the operation of the wrapping machine is automatically stopped whenever an incorrectly placed product is detected. However, while such measures can prevent cutting of products in a wrapping machine, the machine automatically comes to a complete halt when an incorrectly placed product is found, thereby reducing the efficiency of the machine and causing a considerable loss of time and labor for the resumption of operation.

It is therefore an object of the present invention to provide a wrapping method which is free from the above described problems and according to which the conveyer, the film feed section and the top sealing section of a wrapping machine are driven by their respective driving motors which are logically coordinated so that, even if one of the component units is stopped, the operation of the other units is maintained without interruption. With this method, the servomotor or motor provided with an inverter which is used for driving the top sealing section is controlled by appropriately utilizing rotary angle signals coming from the conveyer and a cut-in warning signal which is produced wheneven an incorrect placement of a product is detected in such a manner that, when the product whose faulty positioning has been detected reaches the top sealing section, the operation of only the melt-cutting blades is temporarily stopped and, after the product has been moved away from the section, the melt-cutting blades return to their normal operation with the product immediately after the faulty one, thereby ensuring normal operation of the conveyer and the film feed section including the center sealing unit during the temporary stop of the operation of the cutting blades and consequently eliminating any loss of labor and time required for the resumption of operation so that a considerable improvement of operational efficiency may be achieved.

SUMMARY OF THE INVENTION

According to the present invention, the above and other objects of the invention are achieved by a wrapping method using a wrapping machine having a conveyer driven by a motor for moving products one by one at a predetermined speed to a film feed section, where said products are forwarded into a tube of film formed by sealingly bonding the opposite edges of a continuous sheet of film fed from a roll of film, said tube of film containing goods therein being cut by a pair of melt-cutting blades along marked lines found between each two successive products at a top sealing section, wherein the film feeding operation and the center sealing operation conducted in said film feed section are powered by a first control motor and the melt-cutting blades in the top seal section is powered by a second control motor, said first and second motors being different from the motor for driving said conveyer, rotary angle signals emitted from an encoder connected to a rotary shaft that rotates in synchronism with the rotation of the conveyer and cut-in warning signals emitted from a detector-sensor that detects any objects in the danger zone provided before and after the cutting mark being sent to an electric controller, one of whose outputs being applied to said first control motor to drive it in synchronism with the conveyer on the basis of power logical coupling while the other output being applied to said second control motor so that the operation of the melt-cutting blades is temporarily halted when the danger zone has generated a cut-in warning signal and the normal melt-cutting operation is resumed from the cutting mark immediately after the faulty one.

According to the present invention, whenever a product is displaced from its normal position on the conveyer and moved to the center sealing section, the displacement is detected by the detector-sensor and a cut-in warning signal is emitted therefrom while a rotary angle signal that corresponds to the position of the faulty product is transmitted from the conveyer which is running at a constant speed to control the second control motor that drives the melt-cutting blades of the top sealing section so that the melt-cutting operation is temporarily stopped at the time when said incorrectly located product that has been detected by the detector-sensor reaches a predetermined area immediately before the melt-cutting blades to avoid any cut-in a accident, while both the conveyer and the center sealing section are driven without interruption by their respective motors. Therefore, products can be supplied to the conveyer at a constant rate and then forwarded to the center-sealing section regardless of existence of incorrectly placed products, while the melt-cutting blades maintains its normal cutting operation except when incorrectly placed products are found and made to pass through the blades without being cut so that products that have been individually wrapped and separated from each other are obtained as final products except faulty ones which come out unwrapped and the wrapping operation is kept going on without interruptions.

BRIEF DESCRIPTION OF THE DRAWINGS

The present invention will be described in greater detail by referring to the accompanying drawings which illustrate an embodiment of the invention. In the drawings.

DETAILED DESCRIPTION OF THE PREFERRED EMBODIMENTS

Figure 1:
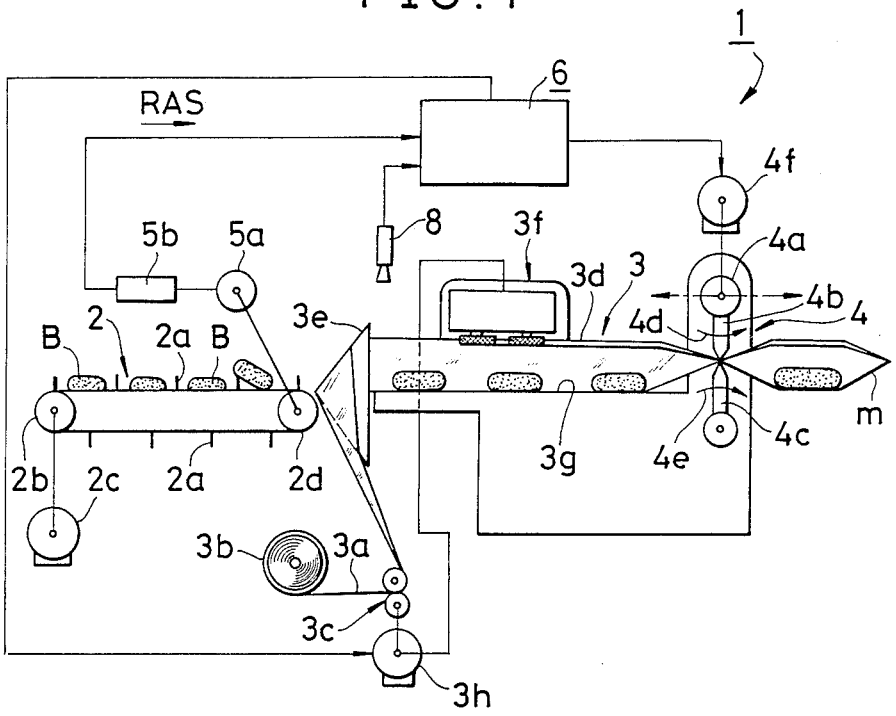
FIG. 1 is a schematic side view of a wrapping machine that embodies the wrapping method according to the present invention.

Referring to FIG. 1, a wrapping machine which embodies the wrapping method according to the present invention and is generally denoted by reference numeral 1 comprises, like a conventional wrapping machine, a conveyer 2, a film feed section 3 located adjacent to said conveyer and a top sealing section 4 located at the rear ead of the line.

In conveyer 2, reference symbols 2*a*, 2*a*, . . . denote partitions and products B, B . . . are placed one by one within the compartments formed by said partitions 2*a*, 2*a*, . . . The conveyer also comprises a driving pulley 2*b* which is driven by a motor 2*c*.

The film feed section 3 which is located immediately downstream of the conveyer in the line comprises a feed roller 3*c* for feeding a continuous sheet of film 3*a* which is made of synthetic resin of a known type from a roll of film 3*b*, a rounder 3*e* of a known type for rounding said sheet of film 3*a* to form a tube of film 3*d*, a center sealing unit 3*f* for melt-bonding the lateral edge of said tube of film 3*d* and a transfer table 3*g* for transferring products B, B . . . along with the tube of film 3*d*, wherein said feed roller 3*h* and center sealing unit 3*f* are driven by a first control motor which is actually a servomotor, a motor provided with an inverter, a CD control motor, a stepping motor or a pulse motor.

Like a conventional wrapping machine, the above machine further comprises a melt-cutting unit 4*a* in the top sealing section 4, which is normally a rotary cutter having a driving blade 4*d* and an interlocked blade 4*c* which respectively rotate in the directions indicated by arrows to melt-cut the tube of film 3*d* with their edges so that the cut and parallelly arranged edges of the tube of film are melt-bonded.

While the configuration of the above described wrapping machine resembles that of a conventional wrapping machine in many aspects, the difference between them resides in the facts as described below.

Firstly, in the wrapping machine that embodies the wrapping method of the invention, the rotary motion of the conveyer 2 is transmitted to a rotary shaft 5*a* by way of the interlocked pulley 2*d* and an encoder 5*b* connected with the rotary shaft 5*a* generates rotary angle signals RAS for the interlocked pulley 2*d* running at a constant speed of revolution and sends them to an electric controller 6 provided with a function similar to that of a shift register and a computer.

Figure 2:
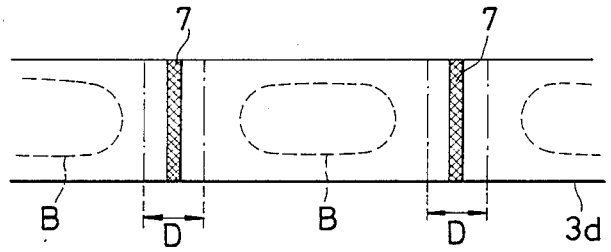
FIG. 2 is a plan view of a continuous tube of film used in the wrapping machine of FIG. 1.

It should be noted that film 3*a* supplied in the form of a roll of film 3*b* as shown in FIG. 2 is of an ordinary type that can be used for a conventional wrapping machine and carries marks for a conventional wrapping machine and carries marks for cutting 7, 7, . . . along the lines to be cut by the melt-cutter 4*a* in the top sealing section 4.

Secondly, the film feed section 3 differs from that of a conventional machine, in that a sensor 8 comprising photoelectric tubes located at appropriate positions is provided and directed to said film 3*a*.

Said sensor 8 detects any of products B, B, . . . located in the danger zone D provided immediately before and after the corresponding cutting marks 7, 7 as shown in FIG. 2.

More specifically, if a product B is not correctly loaded in the space between the corresponding partitions 2*a*, 2*a* of the conveyer 2 and placed by mistake on one of the partitions as shown in FIG. 2 (or, in the case of a wad of chinese noodles, if the bag of condensed soup is placed close to the portion 2*a*), the products B are forwarded to the film feed section 3 and further to the top sealing section 4 with the incorrect positioning being carried on, where the product B itself or the bag of soup will be cut by the melt-cutter 4*a* along with the tube of film 3*d*, causing a serious trouble to the overall wrapping operation. In order to avoid such a situation, said sensor 8 plays its role as described further later.

Thirdly, one of the outputs of said electric controller 6 is connected to said first control motor 3*h* of the film feed section 3 to logically couple the conveyer 2 and the film feed section 3 in terms of power so that they are synchronously operated.

Fourthly, the other output of said electric controller 6 is connected with the top sealing section 4 as described below.

As shown in FIG. 1, the melt-cutter 4*a* of the top sealing section 4 is of a rotary type and driven by a second control motor 4*f* which is actually a servomotor or the like and electrically connected in such a manner that it is driven by the output of said electric controller 6.

Figure 3:
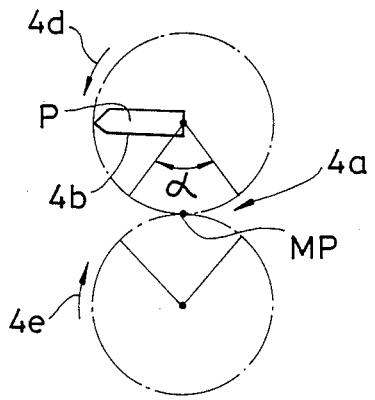
FIG. 3 is a schematic front view of a pair of melt-cutting blades used in the wrapping machine of FIG. 1, illustrating their operation.
Figure 4:
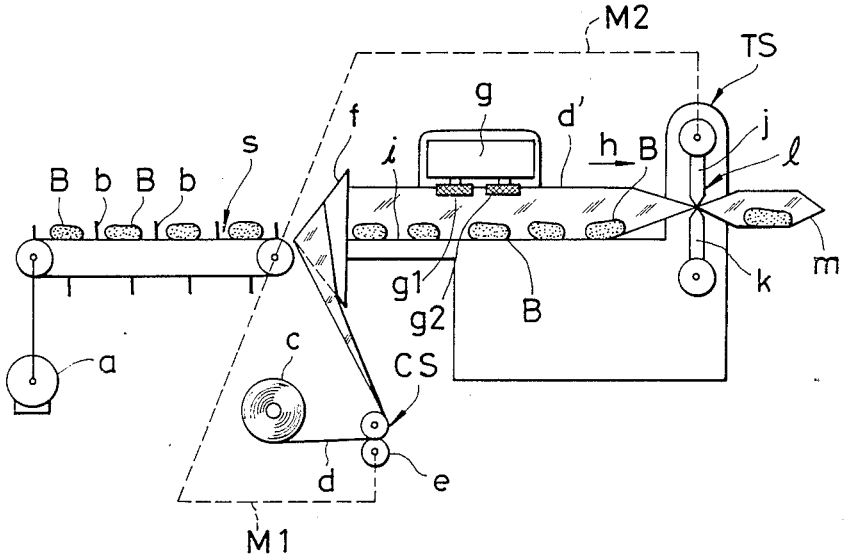
FIG. 4 PRIOR ART
FIG. 4 is schematic side view of a conventional wrapping machine.

The melt-cutter 4*a* which is connected in the manner as described above is controlled with respect to revolution as illustrated in FIG. 3.

The driving blade 4*b* of the melt-cutter 4*a* rotates in the direction as indicated by arrow 4*d* and comes to a temporary halt at the position shown P marked by solid lines, where it resumes its rotary motion upon receiving a start signal triggered by a rotary angle signal RS from the encoder 5*b*. In other words, the driving blade 4*b* does not restart its operation, unless a start signal does not reach the second control motor 4*b* and the melt-cutter 4*a* remains inoperative.

It should be noted that the rotary motion of the driving blade 4*b* which is resumed at the position P occurs only when it is found within a predetermined angle $\alpha$ defined by the lines before and after the sealing point MP and the speed of the rotary motion is controlled to be exactly same with the moving speed of the tube of film 3*d* in the film feed section 3.

Now, the wrapping method according to the present invention proceeds in a wrapping machine as described above in the following manner.

When the wrapping machine 1 is powered, the conveyer 2 which is driven by the motor 2*c* moves forward products B, B, . . . located in the spaced between portions 2*a*, 2*a*, . . .

In the film feed section 3, the feeding roller 3*c* which is driven by the first control motor 3*h* feeds film 3*a* from a roll of film 3*b* to form it into a cylindrical shape by the rounder 3*e* and the lateral edges of the rounded film are melt-bonded together by the center sealing unit 3*f* to produce a tube of film 3*d*, which is then moved to the right as shown in FIG. 1 on the transfer table 3*g* by the center sealing unit 3*f*.

Thus, said products B, B, . . . which are separated from each other by partitions 2*a*, 2*a*, are moved one by one from the conveyer 2 into said tube of film 3*d* with a predetermined distance. Then the tube of film 3*d* containing the products B, B, . . . is cut at the cutting marks 7, 7, . . . on it by the melt-cutter 4 which is driven by the second servomotor electrically connected with the first rotary shaft 5*a*, encoder 5*b*, electric controller 6 and operated in synchronism with the conveyer 2 to obtain packed items m one by one of products B, B, ...

At this stage, the detector-sensor 8 comprising photoelectric tubes checks if there is a product B located in the danger zone D and, when a product B is detected to be in the zone D, a cut-in danger signal is generated and applied to the second control motor 4*f* by way of the electric controller 6 so that, whenever a product in the danger zone D is detected, the operation of the melt-cutter 4*a* is stopped at the position P2 indicated by solid lines as the second control motor 4*f* stops its motion and is resumed only when the product in question B has passed through the melt-cutter 4*a* and the product immediately following the product in question is found to be correctly located, which is then separated from the following product at the cutting mark 7 by the cutting operation of the melt cutter 4*a*.

As is apparent from the above description, with a wrapping method according to the present invention, a melt-cutter ceases its operation whenever a product which is not correctly located is detected and reaches the melt-cutter without interrupting the operation so that the wrapping method according to the present invention may eliminate any possibility of not only of wrapping incorrectly positioned products but also of erroneously cutting products while the wrapping operation is incessantly carried on. Thus, the wrapping method according to the present invention can significantly enhance the efficiency of wrapping operation and eliminate consumption of time and labor required for resumption of the wrapping operation as in the case of using a conventional wrapping method as well as unpleasant fatigue experienced by the operators when the wrapping machine comes to a sudden halt. The method according to the present invention also increases the durability of a wrapping machine because it does not involve any abrupt stopping actions of the machine.

What is claimed is:

1. A wrapping machine comprising:

a conveyer driven by a conveyer motor for moving products at a predetermined speed to a film feed section where said products are forwarded into a tube of film formed by sealingly bonding lateral edges of a continuous sheet of film fed from a roll of film, said tube of film being cut by melt-cutting blades wherein a film feeding operation and a center sealing operation conducted in said film feed section are powered by a first motor;

a second motor powering said melt-cutting blades in said top sealing section;

wherein said first and second motors are different from said conveyer motor;

an encoder generating rotary angle signals, said encoder connected to a rotary shaft that rotates in synchronism with rotation of said conveyer; and a detector generating cut-in warning signals based on said detector detecting objects in a danger zone provided before and after cutting marks; and an electric controller, one of whose outputs being applied to said first motor to drive said first motor is synchronism with said conveyer on the basis of logical coupling of powers while another output is applied to said second motor so that operation of said melt-cutting blades is temporarily halted when said cut-in warning signal is generated and wherein normal melt-cutting operation is subsequently resumed at a cutting mark after a faulty one.

* * * * *